United States Patent [19]

Nakaya

[11] Patent Number: 4,765,214

[45] Date of Patent: Aug. 23, 1988

[54] APPARATUS FOR HANDLING VENEER SHEETS

[75] Inventor: Takashi Nakaya, Obu, Japan

[73] Assignee: Meinan Machinery Works, Inc., Obu, Japan

[21] Appl. No.: 50,631

[22] Filed: May 14, 1987

[51] Int. Cl.[4] ..... B65H 29/26

[52] U.S. Cl. ..... 83/80; 83/79; 83/91; 83/96; 83/106; 83/107; 83/154; 83/155.1; 83/364; 198/693; 271/18.3; 271/180; 414/52

[58] Field of Search ..... 83/79, 80, 91, 96, 86, 83/71, 106, 107, 154, 155.1, 364; 198/693; 144/2 R; 271/18.3, 180, 280; 414/52

[56] References Cited

U.S. PATENT DOCUMENTS 3,272,044 9/1966 Obenshain ..... 83/154 X
4,681,002 7/1987 Nakaya ..... 83/107 X

FOREIGN PATENT DOCUMENTS 595084 7/1981 Japan .

*Primary Examiner*—Frank T. Yost

*Attorney, Agent, or Firm*—Brooks, Haidt, Haffner & Delahunty

[57] ABSTRACT

Veneer handling apparatus having a veneer clipper at one end thereof and a veneer sheet stacker at the other end is disclosed. Veneer sheets cut into a format size by the clipper are sorted so as to allow defective sheets to be discharged from the apparatus. Sound veneer sheets sorted from the defective sheets are distributed selectively into two ways alternately. Two conveyors arranged one above the other and converging at a position adjacent their downstream ends are provided in the apparatus, and one sheet is distributed to the upper conveyor and stopped at a predetermined position thereon until its succeeding sheet distributed to the lower conveyor is moved to another predetermined position. The sheet on the upper conveyor is allowed to move again at such controlled time that it is combined at the converging position with the succeeding sheet moving on the lower conveyor into a pair with one sheet placed over the other. This pair of combined veneer sheets is fed into the stacker with sufficient space formed between another pair of similarly combined sheets that follows.

14 Claims, 3 Drawing Sheets

40
41
S1
S2
S3
D

S1
S2
S3
S4

S1
S2
S3
S4
S5

S1
S2
S3
S4
S5
S6
S7

S3
S4
S5
S7
S8

S3
S4
S5
S7
S8
S9

INSUFFICIENT SPACE
S5
S7
S8
S9
S10

APPARATUS FOR HANDLING VENEER SHEETS

FIELD OF THE INVENTION

The present invention relates generally to an apparatus for handling wood veneer sheets. More specifically, it relates to an apparatus for distributing veneer sheets alternately into two ways so as to permit smooth stacking of such sheets at the final stacking station of the apparatus.

BACKGROUND OF THE INVENTION

In a veneer handling apparatus having a clipper for continuously cutting a ribbon of veneer into sheets, e.g. cut sheets each having a format size of predetermined lengthwise and widthwise dimensions, and also a stacker for stacking such cut sheets into a pile at the final station thereof, it is desirable that the cut sheets adjacent to one another should be fed to the stacker with sufficient space therebetween to ensure smoothness in the stacking operation without causing harmful veneer jamming at the stacker. A short period of time is usually required for each sheet to be positioned properly with respect to a stacker stand on which it is to be stacked and then to be dropped onto a previously formed pile of sheets. If adjacent sheets are fed with insufficient space, a succeeding sheet will enter into the stacker before its preceding sheet is properly dropped for stacking, thus inviting trouble such as interference or jamming of such veneer sheets at the stacking station.

For providing a space between adjacent cut sheets necessary for the above smoothness in stacking operation, there has been proposed a veneer handling apparatus which includes two layers of conveyors arranged one above the other and adapted to receive alternately one incoming sheet at a time. In this proposed apparatus according to the prior art, the upper conveyor has a greater length than the lower one and the two conveyors are arranged so as to meet or converge at a downstream point so that a preceding sheet which moves on the upper conveyor for a greater distance may be placed at the converging point over its succeeding sheet which comes out from the lower conveyor. A pair of these sheets is further moved in such combined relation toward the stacker with a sufficient space formed with respect to their adjacent succeeding pair of similarly combined sheets. In this apparatus, the upper conveyor has a length greater than that of the lower conveyor, as measured from the upstream end thereof to their meeting point, the difference between these lengths being substantially an odd number, e.g. 1, 3 and so forth, times the dimension of the sheet between its opposite cut ends, or the dimension thereof along which it is advanced on the conveyor.

For better understanding of major object that the present invention intends to achieve, the operation of the above prior art will be described more in detail with reference to the illustrative diagrams shown in FIGS. 3A to 3G, wherein the upper conveyor 40 has a distance three times the dimension D of cut sheets each designated by the letter S followed by numerals of serial numbers, and the lower conveyor 41 has a distance two times the dimension D, thus the difference in length being one time the dimension D of the sheet. It is to be understood that for the sake of distinguishing of cut veneer sheets a little space is shown between two adjacent sheets on the upstream or left-hand side of the conveyors 40, 41. The space formed in actual veneer handling practice is only of a magnitude that substantially corresponds to a cutting line between two veneer sheets. Now supposing that successively fed veneer sheets, e.g. S1 through S5, are all sound or have therein no defect, the first sheet S1 fed to the upper conveyor 40 will have to travel a greater distance than its succeeding sheet S2 moving on the lower conveyor 41 by a distance substantially equal to the dimension D of the sheets. Therefore, these two sheets S1 and S2 will meet at the converging point of the two conveyors, as shown in FIG. 3C, and come out therefrom with the sheet S1 placed over the sheet S2 to be advanced further toward a stacker (not shown). Similarly, the sheet S3 travelling on the upper conveyor 40 will be put over the sheet S4 then coming out from the lower conveyor 41. As shown in FIG. 3D, a space substantially equal to the dimension d can be formed between the two adjacent pairs of combined sheets.

However, this conventional apparatus will not perform its intended function if a defective veneer sheet, e.g. sheet S6, is found and therefore removed from the production line, as indicated by the dashed line in FIG. 3D. In such a case, when the sheet S5 reaches the downstream end of the upper conveyor 40, the succeeding sheet S7 is moving on the lower conveyor 41 behind the sheet S5 by a distance of the dimension D, as seen in the step of FIG. 3A. Therefore, the sheet S7 will come out from the conveyor 41 just behind its preceding sheet S5 with very little space formed therebetween, thereby making it difficult to stack these two sheets properly at the subsequent stacking station of the apparatus. The result will be that veneer jamming will result.

In this way, the above-described prior art can function properly when stacking all cut sheets including defective ones, but encounters a problem when such defective sheets are to be removed from the working line of the apparatus.

SUMMARY OF THE INVENTION

Accordingly, a primary object of the present invention is to provide a veneer handling apparatus which can solve the above disadvantage of the prior art for ensuring smoothness in stacking of veneer sheets.

Another object of the invention is to provide a veneer handling apparatus which can automatically sort defective veneer sheets from sound sheets.

The veneer handling apparatus according to the present invention includes a feed conveyor for feeding a ribbon of wood veneer, a veneer clipper located adjacent one end of the apparatus for clipping the veneer ribbon continuously into cut sheets each having a predetermined format size, a detector located upstream of the veneer clipper for detecting any defect in the veneer ribbon, and a veneer stacker located adjacent the other end of the apparatus for stacking veneer sheets in a pile. Downstream of the veneer clipper is provided means for selectively distributing the veneer sheet cut by the clipper. The apparatus further includes control means connected to the detector, clipper and distributing means for judging whether or not each cut veneer sheet is sound having no defective portion in it, and the distribution of the cut veneer sheets by the distributing means is controlled by this control means according to its judgement of the cut veneer sheets.

The control means is adapted to operate on the distributing means in such a way that those cut sheets which are judged by the control means as defective can be sorted from those sheets that are judged as sound and also that such sound veneer sheets may be distributed selectively into two ways alternately by the distributing means.

The apparatus further includes two layers of conveying means extending one above the other and converging at a positio adjacent to their downstream ends for receiving alternately one sound cut sheet at a time from the distrubuting means and for transferring such sheets toward the stacker. The conveyor, e.g. of the lower layer is deiven to move continuously, and the conveyor of the upper layer has means for temporarily stopping a sheet at a predetermined position on the upper conveyor and then allowing the sheet to move again at such a controlled timing that the sheet thus allowed to move may be combined at the converging position with its succeeding sheet moving on the lower conveyor into a pair with one sheet placed over the other.

The stopping means has a first veneer detector for detecting at the above predetermined position a veneer sheet moving on the upper conveyor, a second veneer detector for detecting at another predetermined position a veneer sheet moving behind the above sheet on the lower conveyor, and an intermittently movable portion forming the downstream end of the upper conveyor which is operated intermittently according to the detecting operation of the first and second veneer detectors. The intermittently movable portion is adapted to be stopped when the first veneer detector is operated to detect the sheet on the upper conveyor and started again when the second veneer detector is operated to detect the succeeding sheet moving on the lower conveyor.

The veneer handling apparatus thus constructed according to the present invention can make it possible to feed the pairs of combined sheets with sufficient space formed between any two adjacent such pairs, as well as to selectively sort sound veneer sheets from defective ones automatically, thus assuring smoothness in veneer stacking operation without causing troublesome jamming of the veneer sheets during stacking.

These and other objects, features and advantages of the invention will become apparent to those skilled in the art from the following description of a preferred embodiment of veneer handling apparatus according to the present invention, which description is made with reference to the accompanying drawing, wherein:

DETAILED DESCRIPTION OF THE PREFERRED EMBODIMENT

Figure 1:
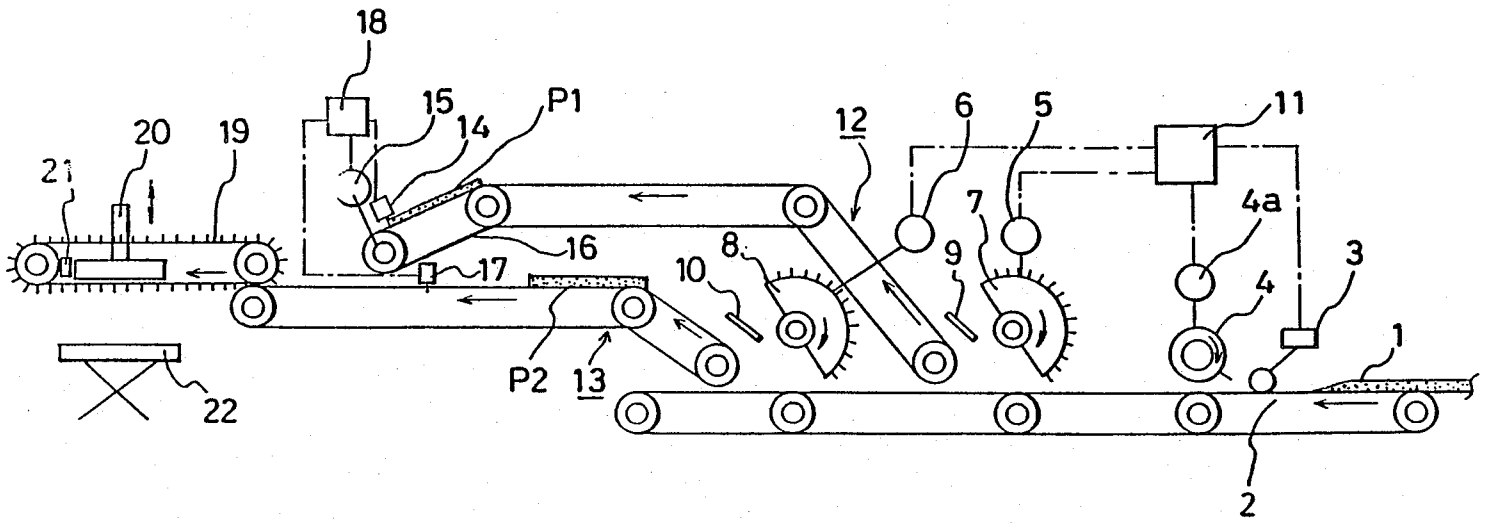
FIG. 1 is a schematic side elevation showing the preferred embodiment of apparatus constructed according to the present invention.

Referring now to FIG. 1 wherein a preferred embodiment of the present invention is shown schematically, there is provided a feed conveyor designated generally by reference numeral 2 for moving a sheet of veneer 1, e.g. a ribbon of veneer just peeled by a veneer lathe (not shown), forward into a rotary veneer clipper 4. Adjacent to the right end of the feed conveyor 2 and upstream of the veneer clipper 4 are located a plurality of veneer detectors 3 (only one being shown in FIG. 1) spaced at an appropriate interval along the direction across which the veneer sheet 1 is advanced, for locating the position or line at which normally irregularly shaped leading end of the incoming veneer sheet 1 is to be cut off for defect removal and also for detecting presence of any defective portion in the same sheet. Each detector 3 may be of a conventional type which includes a roller engageable in contact with the surface of the advancing veneer sheet, a swing arm supporting the roller and a switch, e.g. a microswitch operable in association with the swinging motion of the arm caused by variation in thickness of the veneer sheet then moving just under the rollers. The veneer detectors 3 are electrically connected to a control circuit 11. In the illustrated embodiment, it is so arranged that each veneer detector 3 will be turned ON when its roller is swinged to its uppermost position where it detects the full thickness of the veneer sheet 1 then moving past the roller, that an electrical signal is applied to the control circuit 11 while all the detectors 3 are placed in their ON positions, and that such application of the detector signal to the control circuit 11 is interrupted while at least any one of the detectors 3 is turned OFF in response to reduction in thickness, or absence of the full thickness, representing the presence of any defective portion in the sheet. The control circuit 11 has a built-in pulse counter serving as a delay control circuit.

The rotary veneer clipper 4 is of a well-known type which is adapted to cut off the irregularly shaped leading end of a veneer sheet for trimming and to subsequently sever the sheet 1 continuously into successive cut sheets each having a predetermined width, or a dimension between the cut ends of the clipped sheet as measured along the fiber orientation of the wood veneer, for producing veneer sheets of the desired format size of dimensions. For the sake of distinction of veneer sheets before and after being cut by the clipper 4, the sheet thus clipped into the format size is referred to as veneer sheet P. The drive (not shown) of veneer clipper 4 is connected to the control circuit 11 by way of a clutch-brake unit 4*a* which, when its clutch is engaged and brake released, causes the clipper 4 to rotate for continuous clipping operation. The clutch-brake unit 4*a* is virtually a combination of clutch and brake, which clutch is adapted to make selective connection and disconnection of power from a motor (not shown) to the clipper 4 with simultaneous releasing and application of the brake, respective.

Disposed downstream of the veneer clipper 4 is veneer pickup means such as a plurality of pickup wheels 7 (only one being shown in the drawing) which are arranged in a row and spaced from each other at an appropriate interval in the direction across which the cut veneer sheets P are moved on the feed conveyor 2. Each of the pickup wheels 7 is spaced from the clipper at an interval distance which is greater than the distance corresponding to the above width of the cut veneer sheet P. Another row of similar pickup means including a plurality of pickup wheels 8 is located further downstream of the pickup wheels 7 at a spaced interval therefrom which may be substantially equal to or greater than the above width dimension. It is to be understood that, for the sake of convenience of illustration of the drawing, the interval distance between the clipper 4 and the pickup wheels 7 is shown shorter than the cut width dimension of the veneer sheet P.

The pickup wheels of each row are driven to rotate on their common shaft, and each pickup wheel 7 or 8 has a semicircular shape as clearly seen in the drawing. Its semicircular periphery as a circumferential distance substantially corresponding to the above width dimension of the format-cut veneer sheet P and has a number of piercing or impaling radial needles protruding therefrom for picking up a veneer sheet P impaled on the pickup wheel by its needles and lifting the sheet as the wheels are rotated in arrow direction. The pickup wheels 7, 8 of each row are driven to rotate intermittently through their respective clutch-brake units 5, 6 which are electrically connected to the control circuit 11 and operable in a similar manner to the unit 4*a* for the rotary clipper 4. The pickup wheels 7 include stripping means, e.g. a plurality of bars 9 (only one being shown) provided such that each bar may be positioned between any two adjacent pickup wheels 7 when their needled peripheries are moved thereacross, for stripping or separating the impaled veneer sheet P away from the pickup wheels as the sheet is moved thereon across the stripping bars. As shown, similar stipping means in the form of bars 10 are provided for the pickup wheels 8.

The manner of operatio of the control circuit 11 in relation to the veneer detectors 3, rotary veneer clipper 4 and veneer pickup wheels 7, 8 is as follows.

When the full thickness of the incoming veneer sheet 1 turns ON all the veneer detectors 3 at a time, i.e. when the detectors 3 locate a positio of initial cutting for eliminating normally irregularly shaped leading end of the veneer sheet for forming a straight, clear-cut end with minimum loss of veneer, the control circuit 11 receives a detector signal which remains effective while the above full thickness is being detected. On receiving such detector signal emitted from the veneer detectors 3, the control circuit 11 in turn transmits a start signal to the clutch-brake unit 4a to energize the same for starting the veneer clipper 4, but with a delay of short period of time which is so preset by the pulse counter in the control circuit 11 that cutting for elimination of the irregularity at the leading end of the veneer sheet 1 may be effected at the right position which had been located by the veneer detectors 3. After making such an initial cut of the sheet 1 for defect removal, the clipper 4 rotating continuously makes successive cuts for producing a format sheet P each time it makes a complete turn.

From the moment when the control circuit 11 has received the detector signal from the detectors 3, the pulse counter in the control circuit starts counting of time, and each time a preset length of time, or the time during which the sheet 1 moves the distance corresponding to the above width of each format sheet P to be formed, is elapsed, the control circuit 11 generates a signal verifying passage of a section of sound veneer for that distance if the detector signal from the veneer detectors 3 remains then effective without being interrupted during each such preset length of time. On the other hand, the rotary veneer clipper 4 transmits a format-cut signal to the control circuit 11 each time the former makes a complete turn for format sheet cutting. Namely, each time a sound format veneer sheet P having herein no defective portion is cut off from the continuous sheet 1, the control circuit 11 receives a format-cut signal from the veneer clipper 4 after generating by itself a signal verifying passage of sound veneer section. To put in other words, the cut sheet P can be judged as a sound sheet by the control circuit 11 when it has generated the passage verifying signal and then received the format-cut signal.

When the control circuit 11 thus ascertains by means of these two different signals that a sund sheet P has been cut, it provides a clutch-ON signal to either of the clutch-brake units 5, 6 to operate its associated pickup wheels 7 or 8, and the other clutch-brake unit is operated similarly when the next sound sheet P has been clipped. In this way, whenever the control circuit 11 generates a signal verifying passage of a sound veneer section for format sheet P to be cut and then receives a signal verifying a cut of that sheet, the clutch-brake units 5, 6 are actuated alternately to thereby energize their associated pickup wheels 7, 8, accordingly.

Each of the clutch-brake units 5, 6 is actuated by the control circuit 11 with such a delay of time that its clutch is engaged when the appropriate pickup wheels 7 or 8 are reached by the cut leasing end of the sheet P. This delay of time is preset by the pulse counter in the control circuit 11. Each clutch-brake unit 5, 6 is adapted to disengage its clutch with simultaneous application of its brake after each complete turn of the pickup wheels 7, 8, respectively, and remains at its stand-by position until it is operated again by the control circuit 11.

On the other hand, in the event that any defective portion in the sheet 1 is detected by any one of the veneer detector 3 during any of the above preset times, the detector signal is interrupted while such defective portion is being detected and, therefore, the control circuit 11 provides no signal verifying passage of sound veneer section at the end of the preset length of time. The format sheet P then produced is recognized by the control circuit 11 as a defective sheet, and the pickup wheels 7 or 8 which would otherwise be operated to pick up a sheet P will be at a stop when the sheet has reached the pickup wheels, with the result that such defective sheet P is moved past under the pickup wheels without being picked up thereby and then dropped off from the delivery end of the feed conveyor 2.

Adjacent and downstream of the respective rows of pickup wheels 7, 8 are disposed continuously rotating conveyors 12, 13 arranged substantially one above the other for receiving the veneer sheets P stripped away from the pickup wheels and for further advancing the same. The upper conveyor 12 has at its downstream end an intermittently operable portion 16 having a veneer detector such as limit switch 14 and a clutch-brake unit 15 connected to a motor (not shown) for intermittently driving the conveyor portion 16. The lower conveyor 13 extends further than the downstream end of the conveyor 16 and includes a veneer detector such as limit switch 17 located at a position substantially corresponding to that of the first limit switch 14. There is provided a control circuit 18 which is connected to the limit switches 14, 17 and clutch-brake unit 15. The control circuit 18 is operable in such a way that the clutch-brake unit 15 is operated so as to stop the conveyor 16 when the limit switch 14 is stricken by the format-cut veneer sheet P moved on the conveyor 12 and then to allow the conveyor 16 to start when the veneer sheet P advanced on the conveyor 13 strikes its limit switch 17 so that the two sheets P on the conveyors 12 and 13 may be transferred with one sheet placed over the other toward a veneer stacking device which is connected to the delivery end of the conveyor 13.

The veneer stacker is of a well-known type, including endless conveyor belts 19 trained around driven pulleys and each having a number of needles for impaling and transferring two veneer sheets P thereunder at a time, means for stripping the sheets away from the needles, such as vertically movable bar 20, a veneer detector such as a limit switch 21 providing, when stricken by an in coming sheet, an electrical signal for actuating the stripping bar 20, and a scissor lift 22 on which the veneer sheets P stripped away from the pickup conveyor 19 are piled in a stack.

The following will describe the operation of the apparatus thus constructed.

The veneer sheet 1 is advanced by the feed conveyor 2 toward the clipper 4. When the leading end portion of such incoming veneer sheet 1 turns ON all the veneer detectors 3 at a position on the sheet where it is desired to be cut for removal of its irregularly shaped end, the control circuit 11 receives a detector signal from the veneer detectors 3 and then provides a start signal to the clutch-brake unit 4a for the clipper 4 with a delay of short period of time preset by the pulse counter in the control circuit 11. The clipper 4 is thus started to rotate continuously, making an initial cut for removal of the defective leading end and then clipping the sheet 1 successively into format-sized sheets P. For better understanding of the operation of the apparatus, the format sheets P thus produced successively by continuous rotation of the clipper 4 are referred to as P1, P2, P3 and so forth.

If the veneer sheet 1 contains no defective portion at least over the distance corresponding to a series of format sheets to be cut, e.g. P1 thrugh P5, the detector signal from the veneer detectors 3 remains effective for the aforementioned preset length of time for a veneer section corresponding to the sheet P1 to be formed and the control circuit 11, therefore, provides a signal verifying passage of a sound veneer section at the end of the preset length of time. After receiving a format cut signal from the rotary veneer clipper 4 when it has made a turn to cut the first format sheet P1, the control circuit 11 transmits a signal firstly to energize the clutch-brake unit 5 for the pickup wheels 7 with a delay of time so that the wheels are just rotated when they are reached by the cut leading end of the sheet P1. The second format sheet P2 cut by the clipper 4 in the same way as its preceding sheet P1 is moved under the pickup wheels 7, which is then at a rotated position that allows the sheet P2 to move therepast, until it reaches the pickup wheels 8, where the clutch-brake unit 6 is energized by the control circuit 11 so that the second sheet P2 is picked up by the pickup wheels 8. Thus, the first cut format sheet P1 lifted up by the pickup wheels 7 is separated away therefrom by the stripping bars 9 and then transferred onto the conveyor 12, while the second format sheet P2 stripped away from the pickup wheels 8 by the stripping bars 10 is transferred to the conveyor 13.

As the sheet P1 moving on the upper conveyor 12 strikes the limit switch 14, the control circuit 18 operates on the clutch-brake unit 15 to stop the intermittently operable conveyor portion 16. Thus, the sheet P1 is kept at rest on the conveyor 16. As the second sheet P2 moving on the lower conveyor 13 behind the sheet P1 strikes the limit switch 17, the clutch-brake unit 15 is operated to start the conveyor 16 again, thus allowing the sheet P1 to move again and be placed onto the sheet P2 then moving past the delivery end of the conveyor 16.

These two format sheets P1 and P2 arranged one on the other are impaled by the needled endless conveyor belts 19 and further advanced. When they strike the limit switch 21 located adjacent one pulley, the vertically movable bar 20 makes a stroke of reciprocating motion thereby stripping the veneer sheets P1, P2 together to put them on the stacker stand 22.

In the same way, the next sheet P3 (not shown) is lifted by the pickup wheels 7 and distributed to the conveyor 12, while the next sheet P4 (not shown) is picked up by the downstream pickup wheels 8 and transferred to the conveyor 13, and these two sheets P3 and P4, lapped one over the other, are further conveyed for being stacked onto a previously formed pile of veneer sheets on the stacker stand 22. Stacking of two cut sheets P at a time is performed repeatedly in the above manner.

If any defective portion in the veneer sheet 1 appears, e.g., in the next cut sheet P6 (not shown) the detector signal will be interrupted when the veneer detector 3 responding to the defect is turned OFF, so that no signal verifying passage of a sound veneer section is generated by the control circuit 11 at the end of the above preset length of time for the sheet P6. Therefore, though the previous sheet P5 is picked up by the pickup wheels 7 and distributed to the conveyor 12, the defective sheet P6 is just moved past under the pickup wheels 8 which are then at rest without rotating. The sheet P6 moving beyond the pickup member 8 is dropped off the delivery end of the conveyor 2 for separation thereof from other sound cut sheets. The next format-cut sheet P7, (not shown) if judged by the control circuit 11 as sound sheet, will be lifted by the pickup wheels 8, distributed to the conveyor 13, and combined at the delivery end of the conveyor 13 with the previous sheet P5.

In this way, the control circuit 11 operates on the clutch-brake units 5 and 6 in such a manner that only the format-cut sheets P recognized by the control circuit 11 as sound sheets may be picked up, one sheet at a time alternately, by the respective groups of pickup wheels 7 and 8, irrespective of formation of defective format-cut sheets.

Figure 2:
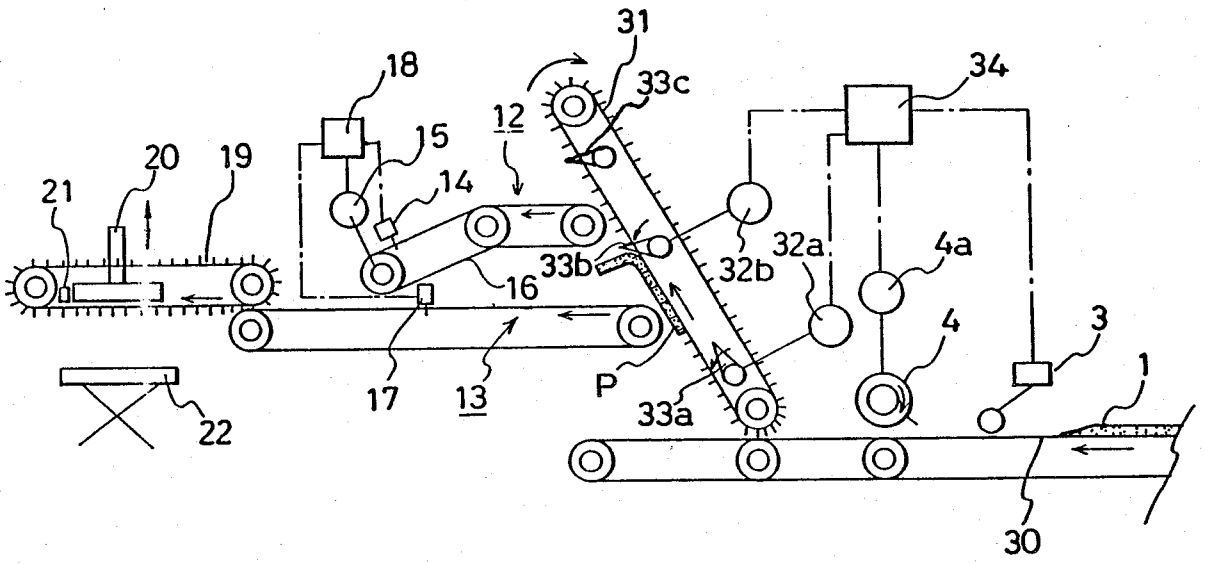
FIG. 2 is also a schematic view showing another embodiment of the invention.
Figures 3A, 3B, 3C, 3D, 3E, 3F, 3G:
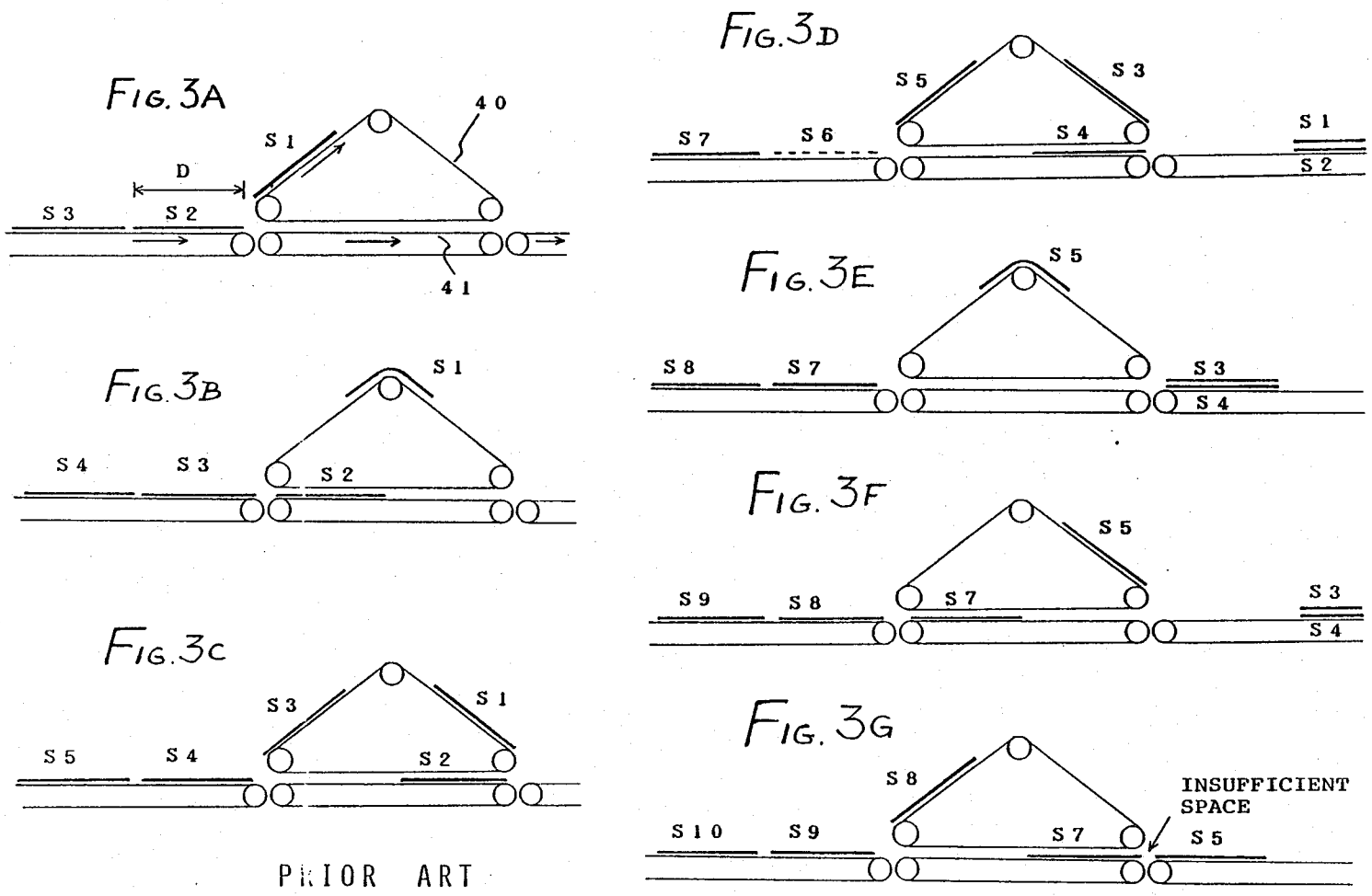
PRIOR ART FIG. 3D
FIGS. 3 is an illustrative views showing the manner in which veneer sheets are handled by the apparatus of prior art which has been already described in reference to the background of the invention.

Reference being made now to FIG. 2, there is shown a modified embodiment of the invention. As shown in the drawing, there is provided a feed conveyor designated generally by reference numeral 30 for moving a ribbon of veneer 1 into a rotary veneer clipper 4 by way of a plurality of veneer detectors 3 arranged at a spaced interval across the direction in which the veneer ribbon 1 is fed toward the clipper 4. These veneer detectors 3 and veneer clipper 4 are connected to a control circuit 34 and operate substantially in the same manner as their counterparts which have been described in detail with reference to the first preferred embodiment illustrated in FIG. 1.

Disposed downstream of the veneer clipper 4 is pickup and distributing means including a plurality of endless belts 31 trained around driven pulleys and each having on its surface a number of impaling needles projecting outwardly for picking up a format-cut veneer sheet P and then transferring the sheet obliquely upwards. Unlike the pickup wheels 7, 8 of FIG. 1, the pickup belts 31 are driven to rotate continuously. The pickup and distributing means further includes stripping means, such as a plurality of fixed levers **33*c* (only one being shown in the drawing) positioned with their tip ends projecting out through the spaces formed between adjacent needled endless belts 31 and two rows of swingable levers 33*a* and 33*b* (only one being shown for each row) located similarly as the fixed ones 33*c* but operable by their respective actuators 32***a* and 32*b* to turn between their operative and inoperative positions. These actuators are connected to the control circuit 34, respectively. The swing levers, when placed in the inoperative position as shown by the lever 33*a*, allow the veneer sheet P to move therepast further upwards on the belt, but when swung to the operative position with their tip ends projecting beyond the impaling needles on the belts as shown by the stripping levers 33*b*, they work to deflect the impaled veneer sheet P and separate it away from the pickup belts 31 as the sheet is moved therewith and deflected by such swing levers.

The manner in which a format-cut veneer sheet P is judged as a sound or defective sheet is the same as that in the first preferred embodiment. However, the second embodiment differs from the first one in that when a cut sheet P is recognized by the control circuit 34 as a defective sheet, the actuator 32*a* is turned ON by a signal from the control circuit at a controlled time so that the lever 33*a* is moved to its operative stripping position just before the defective sheet reaches the lever; and when a cut sheet is judged as a sound sheet, the actuator 32*b* is turned ON by the control circuit once for each two such judgements so that sound veneer sheets P may be stripped away from the pickup belts 31 alternately by the swingable lever 33*b* and the fixed lever 33*c*. The actuator 32*b* is turned ON at such a controlled time that its associated lever 33*b* may be moved to its operative position just before it is reached by the appropriate sheet P. The time at which the actuator 32*b*, as well as the actuator 32*a*, are turned ON is controlled by a pulse counter incorporated in the control circuit 34. As to the actuator 32*a*, it can be turned ON in response to the initial cutting of an irregularly shaped leading end of the sheet 1.

Two conveyors 12 and 13 are arranged one above the other adjacent the levers 33*c* and 33*b*, respectively, for receiving a veneer sheet P separated away from the pickup member 31 by their corresponding levers and for further advancing the same sheet. Like the arrangement described in reference to FIG. 1, the upper conveyor 12 has at its downstream end an intermittently operable conveyor 16 having a limit switch 14 connected to a control circuit 18 and a clutch-brake unit 15 electrically interposed between the control circuit and a motor (not shown) for intermittently driving the conveyor 16, while the lower conveyor 13 extends beyond the downstream end of the conveyor 16 and includes a limit switch 17 located at a position substantially corresponding to that of the first limit switch 14. The manner in which the control circuit 18 operates on the clutch-brake unit 15 in response to the operation of the limit switches is substantially the same as that of the previous preferred embodiment of FIG. 1.

A stacking device is connected to the delivery end of the conveyor 13. Since this device is constructed and operated as described in detail previously with reference to the first embodiment of FIG. 1, no further explanation will be made.

The apparatus thus constructed operates as follows.

A continuous ribbon of veneer 1 having a normally irregularly shaped leading end is guided and fed by the feed conveyor 2 toward the clipper 4. As the leading end of the incoming veneer sheet 1 turns ON all the veneer detectors 3 at a position where the sheet 1 is desired be cut for removal of its irregularly shaped end, the control circuit 11 receives a detector signal from the veneer detectors 3 and then transmits a start signal to the clutch-brake unit 4a for the clipper 4 with a delay of a short period of time preset by the pulse counter built in the control circuit 11. The clipper 4 is thus started to rotate continuously, thereby making an initial cut for removal of the defective leading end of the veneer sheet 1, and thereafter clipping the sheet continuously into successive format-sized sheets P.

The irregular end portion thus cut off from the sheet 1 is picked up by impaling needles on the pickup belts 31 and moved therewith until it is separated therefrom by the lever 33*a* which is in its stripping position. Format-sized veneer sheets P judged by the control circuit 34 as sound are picked up and elevated beyond the lever 33*a*, and distributed alternately to the conveyors 12 and 13 by alternate stripping and deflecting action of the levers 33*c* and 33*b*, which action is accomplished by operation of the actuator 32*b* at the above-described frequency.

If there exists a format-cut sheet P judged by the control circuit 34 as defective, a signal to energize the actuator 32*a* is transmitted by the control circuit and such defective sheet is stripped away from the conveyor 31 by the stripping lever 33*a* and dropped off the discharge end of the conveyor 30, accordingly.

The sound format sheets P thus separated and distributed to the conveyors 12 and 13 are combined in pairs with one sheet from the upper conveyor 16 placed on the other sheet moving on the conveyor 13 and transferred to the conveyor belts 19 of the stacking device for the final stacking operation.

While the invention has been described and illustrated specifically with reference to the preferred embodiments, it is to be understood that the invention can be changed or modified without departing from the spirit or scope thereof. For example, the pickup means 7, 8 and 31, as well as the conveyor 19, may be of a suction type which picks up and holds a veneer sheet thereon by means of suction.

What is claimed is:

1. Veneer handling apparatus having a feed conveyor for feeding a ribbon of wood veneer, a veneer clipper disposed adjacent one end of said apparatus for clipping said veneer ribbon continuously into cut sheets each having a predetermined size, a detector located upstream of said veneer clipper with respect to the movement of veneer ribbon in the apparatus for detecting any defect in said veneer ribbon, and a veneer stacker located adjacent the other end of said apparatus for stacking veneer sheets in a pile, said apparatus comprising:

means disposed downstream of said veneer clipper for selectively distributing said cut veneer sheet;

control means connected to said detector, clipper and distributing means, for judging whether or not each cut veneer sheet is sound having no defective portion in it and also for controlling the distribution of cut sheets by said distributing means according to the judgement by said control means;

said control means being operable on said distributing means in such a way that those cut sheets which are judged as defective are sorted from those other sheets which are judged as sound and also that such sound veneer sheets are distributed selectively into two ways alternately by said distributing means;

two layers of conveyors extending at vertically spaced intervals and converging at a position adjacent their downstream ends for receiving alternately one sound cut sheet at a time from said distributing means and for transferring such sheet toward said stacker, the conveyor of one layer being driven to move continuously, and the conveyor of the other layer having means for temporarily stopping a veneer sheet at a predetermined position on the conveyor of the other layer and then allowing the sheet to move again at such a controlled time that the sheet thus allowed to move is combined at said converging position with its succeeding sheet moving therebehind on the conveyor of the one layer into a pair with one sheet placed over the other.

2. Veneer handling apparatus according to claim 1, wherein the conveyor of the one layer is extended below the conveyor means of the other layer, and said stopping means includes a first veneer detector for detecting at said predetermined position said sheet moving on the conveyor of the other layer, a second veneer detector for detecting at another predetermined position said succeeding sheet moving on the conveyor of the one layer and an intermittently movable portion of the conveyor of the other layer which is operated intermittently according to the detecting operation of said first and second veneer detectors, said intermittently movable portion being stopped when said first veneer detector is operated to detect said sheet and started to move again when said second veneer detector is operated to detect said succeeding sheet.

3. Veneer handling apparatus according to claim 2, wherein said intermittently movable portion forms the downstream end of the conveyor of the other layer, and said predetermined positions for said first and second veneer detectors are located at substantially the same distance from said converging position.

4. Veneer handling apparatus according to claim 1, wherein said control means provides a control signal to said distributing means each time a judgement is made by said control means that a sound veneer sheet has been cut by said clipper.

5. Veneer handling apparatus according to claim 4, wherein said distributing means includes two veneer sheet pickup means disposed above and adjacent said feed conveyor for picking up cut veneer sheets moving on said feed conveyor, said control means providing said control signal alternately to said pickup means at a controlled time so as to allow each pickup means to pick up alternately a sound cut veneer sheet from said feed conveyor.

6. Veneer handling apparatus according to claim 5, wherein said two pickup means are spaced apart from each other in the direction of movement of said cut sheets at least at an interval corresponding to the dimension of said cut sheet as measured along said direction, one pickup means being operable to distribute its picked-up sheet to said conveyor of the one layer and the other pickup means being operable to distribute its picked-up sheet to the conveyor of the other layer.

7. Veneer handling apparatus according to claim 6, wherein each of said pickup means includes a semicircular wheel having on its semicircular periphery a number of impaling radial needles protruding therefrom for picking up a veneer sheet by said needles and means for stripping the impaled sheet away from said needles, said periphery of the wheel having a circumferential distance substantially corresponding to the dimension of the cut sheet in its direction of movement.

8. Veneer handling apparatus according to claim 1, wherein said control means transmits first and second control signals to said distributing means according to the judgement made by said control means so as to control the operation of said distributing means.

9. Veneer handling apparatus according to claim 8, wherein said distributing means includes a loop of a continuously moving endless belt disposed with one end of said loop located above and adjacent said feed conveyor and having on the surface thereof a number of impaling needles projecting outwardly for picking up cut veneer sheets by said needles from said feed conveyor and transferring them upwards, said distributing means further including means for deflecting the upward movement of the impaled veneer sheets while stripping them away from the impaling needles.

10. Veneer handling apparatus according to claim 9, wherein said deflecting means includes two levers movable between their operative position where the veneer sheet impaled by the needles and moving with said belt may be stripped away from the impaling needles and deflected away from the belt and their inoperative position where the sheet impaled by the needles is allowed to move therepast without being stripped away thereby, said deflecting means further including a lever which is fixed in its deflecting operative position.

11. Veneer handling apparatus according to claim 10, wherein said first control signal is transmitted each time a judgement is made by said control means that a defective veneer sheet has been cut by said clipper and said second control signal is transmitted once for each two times of judgement by the control means that a sound veneer sheet has been cut by the clipper.

12. Veneer handling apparatus according to claim 11, wherein one movable lever is operated to move to its operative position in response to said first control signal and the other movable lever is operated to move to its operative position in response to said second control signal.

13. Veneer handling apparatus according to claim 12, wherein said first control signal is transmitted at such controlled time as to cause stripping of said defective veneer sheet and said second control signal is transmitted at such controlled time as to cause stripping of the sound veneer sheet.

14. Veneer handling apparatus according to claim 13, wherein said fixed deflecting lever is positioned so as to deflect the veneer sheet onto the conveyor of the upper layer and said other movable lever is positioned so as to deflect the veneer sheet onto the conveyor of the lower layer.

* * * * *

UNITED STATES PATENT AND TRADEMARK OFFICE

CERTIFICATE OF CORRECTION

PATENT NO. : 4,765,214

DATED : August 23, 1988

INVENTOR(S) : T. Nakaya

It is certified that error appears in the above-identified patent and that said Letters Patent is hereby corrected as shown below:

Col. 1, line 65, after "distinguishing" delete "of"

Col. 3, line 7, correct spelling "position"

Col. 3, line 11, correct spelling "driven"

Col. 3, line 55, delete "3 is an", insert --3A to 3G are a series of--

Col. 3, line 57, after "been", delete "already"

Col. 3, line 68, after "cent", delete "to"

Col. 4, line 5, after "which", insert --a--

Col. 4, line 6, after "of", delete "the", insert --an--

Col. 4, line 17, after "arranged", insert colon --:--

Col. 4, line 19, delete "swinged", insert --swung--

Col. 4, line 22, after "11" delete "while", insert --when--

Col. 4, line 24, delete "while", insert --when--

Col. 4, line 27, delete "any", insert --a--

Col. 4, line 50, change "respective" to --respectively--

UNITED STATES PATENT AND TRADEMARK OFFICE

CERTIFICATE OF CORRECTION

PATENT NO. : 4,765,214

DATED : August 23, 1988

INVENTOR(S) : T. Nakaya

It is certified that error appears in the above-identified patent and that said Letters Patent is hereby corrected as shown below:

Col. 5, line 10, delete "in arrow direction", insert --the direction of the arrows--

Col. 5, line 22, after "similar" correct spelling "stripping"

Col. 5, line 24, correct spelling "operation"

Col. 5, line 28, after "at" delete "a", insert --one--

Col. 5, line 29, correct spelling "position"

Col. 5, line 30, after "eliminating" insert --a--

Col. 5, line 39, after "delay of", insert --a--

Col. 5, line 63, delete "herein"

Col. 5, line 66, after "of", insert --a--

Col. 6, line 27, correct "detector" to --detectors--

Col. 6, line 50, delete "further than", insert --beyond--

Col. 6, line 58, delete "stricken", insert --actuated--

Col. 7, line 4, delete "stricken", insert --actuated--

Col. 7, line 5, correct "in coming" to --incoming--

Col. 7, line 19, before "short" insert --a--

UNITED STATES PATENT AND TRADEMARK OFFICE

CERTIFICATE OF CORRECTION

PATENT NO. : 4,765,214

DATED : August 23, 1988

INVENTOR(S) : T. Nakaya

It is certified that error appears in the above-identified patent and that said Letters Patent is hereby corrected as shown below:

Col 7, line 30, correct spelling "through"

Col. 8, line 17, after "(shown)", insert comma --,--

Signed and Sealed this

Sixteenth Day of May, 1989

*Attest:*

DONALD J. QUIGG

*Attesting Officer*

*Commissioner of Patents and Trademarks*